US008955330B2

(12) United States Patent
Narcus et al.

(10) Patent No.: US 8,955,330 B2
(45) Date of Patent: Feb. 17, 2015

(54) TURBINE COMBUSTION SYSTEM LINER

(75) Inventors: Andrew R. Narcus, Loxahatchee, FL (US); Kristel Negron-Sanchez, Isabela, PR (US); John Pula, Jupiter, FL (US); Neal Therrien, Stuart, FL (US)

(73) Assignee: Siemens Energy, Inc., Orlando, FL (US)

( * ) Notice: Subject to any disclaimer, the term of this patent is extended or adjusted under 35 U.S.C. 154(b) by 772 days.

(21) Appl. No.: 13/212,248

(22) Filed: Aug. 18, 2011

(65) Prior Publication Data

US 2012/0247111 A1 Oct. 4, 2012

Related U.S. Application Data

(60) Provisional application No. 61/468,674, filed on Mar. 29, 2011.

(51) Int. Cl.
*F23R 3/04* (2006.01)
*F23R 3/00* (2006.01)

(52) U.S. Cl.
CPC ..... *F23R 3/002* (2013.01); *F23R 3/005* (2013.01); *F23R 2900/03043* (2013.01)
USPC ..... 60/752; 60/755

(58) Field of Classification Search
CPC ..... F23R 3/002; F23R 3/005; F23R 3/04; F23R 2900/03043; F01D 9/023
USPC ..... 60/752, 755, 757, 759, 760
See application file for complete search history.

(56) References Cited

U.S. PATENT DOCUMENTS

| | | | | |
|---|---|---|---|---|
| 2,617,255 | A * | 11/1952 | Niehus | 60/748 |
| 5,327,727 | A | 7/1994 | Ward | |
| 5,724,816 | A | 3/1998 | Ritter et al. | |
| 5,906,093 | A * | 5/1999 | Coslow et al. | 60/777 |
| 6,334,310 | B1 | 1/2002 | Sutcu et al. | |
| 6,681,578 | B1 | 1/2004 | Bunker | |
| 7,007,482 | B2 | 3/2006 | Green et al. | |
| 7,104,067 | B2 | 9/2006 | Bunker | |
| 7,269,957 | B2 | 9/2007 | Martling et al. | |
| 7,373,778 | B2 | 5/2008 | Bunker et al. | |
| 7,386,980 | B2 | 6/2008 | Green et al. | |
| 8,201,412 | B2 * | 6/2012 | Dugar et al. | 60/752 |
| 2009/0120093 | A1 | 5/2009 | Johnson et al. | |
| 2009/0145132 | A1 | 6/2009 | Johnson et al. | |
| 2009/0282833 | A1 * | 11/2009 | Hessler et al. | 60/757 |
| 2010/0005803 | A1 | 1/2010 | Tu et al. | |

FOREIGN PATENT DOCUMENTS

CN 101832555 A2 9/2010

* cited by examiner

*Primary Examiner* — J. Gregory Pickett

(57) ABSTRACT

A combustion chamber liner (41) with a forward section (44) and an aft section (46). The aft section has an array of aft axial cooling fins (62) covered by a tubular support ring (52), thus forming an array of aft axial grooves (66) between the aft axial fins. Inlet holes (54) in the front end of the support ring may admit coolant (37) into an upstream end of the aft axial cooling fins. An impingement plenum (61) may receive the coolant just before the aft axial cooling fins. Each aft axial fin may include a plurality of axially spaced bumpers (64) that contact the support ring. Spaces or grooves (68) between the bumpers provide circumferential cross flow of coolant between the grooves. The aft axial grooves may discharge the coolant as film cooling along the inner wall (76) of a transition duct (28).

20 Claims, 6 Drawing Sheets

TURBINE COMBUSTION SYSTEM LINER

This application claims benefit of the 29 Mar. 2011 filing date of U.S. Application No. 61/468,674, which is incorporated herein by reference in its entirety.

FIELD OF THE INVENTION

This invention relates to gas turbine combustion system liners and particularly to the cooling configuration of a combustion chamber liner.

BACKGROUND OF THE INVENTION

A common industrial gas turbine engine configuration utilizes multiple combustors in a circular array about the engine shaft in a "can annular" configuration. A respective array of transition ducts connects the outflow of each combustor to the turbine inlet. Each combustor has an air inlet, followed by a fuel injection assembly, followed by a combustion chamber enclosed by a tubular liner, which is often of double-wall construction. The aft or downstream end of the combustion chamber liner connects to the upstream end of the transition duct. The combustor liner isolates the extreme temperature, flame, and byproducts produced by the combustion process, and directs the resulting hot working gas into the turbine section of the engine via the transition duct.

It is important to keep the temperature of the combustor liner within design limits while using minimum cooling air. The cooling air comes from the compressor of the engine. Any air diverted for engine cooling reduces the air available for combustion. Therefore, the less compressed air that is diverted, the more efficient is the engine. Also, the less compressed air that is used for film cooling of the combustor liner the less the working gas is diluted, which also improves engine efficiency. However, exceeding the temperature limits of the combustor liner can produce thermal coating spallation, base metal oxidation, and undesirable hot gas flow path deformation, so highly effective cooling is needed.

BRIEF DESCRIPTION OF THE DRAWINGS

The invention is explained in the following description in view of the drawings that show.

DETAILED DESCRIPTION OF THE INVENTION

Embodiments of the present turbine combustor liner assembly incorporates a cooling fin configuration that improves heat transfer, reduces excessive localized heating and improves overall combustion system durability. It also maintains the qualities of the hot gas path flow while reducing base metal temperatures thus improving overall combustion system durability.

Figure 1:
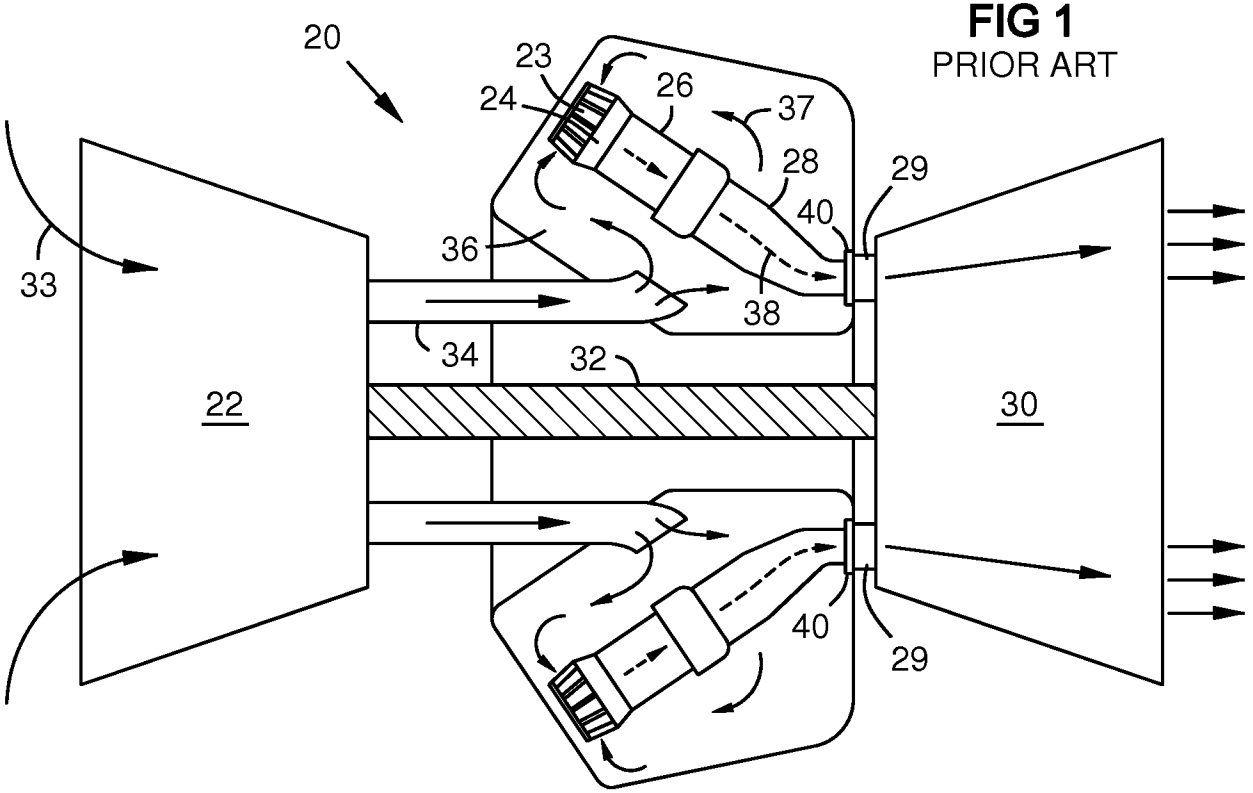
FIG 1 PRIOR ART
FIG. 1 is a schematic view of a prior art gas turbine engine.

FIG. 1 is a schematic view of an exemplary gas turbine engine 20 within which embodiments of the invention may be employed. Engine 20 may include a compressor 22, fuel injectors housed within cap assemblies 24, combustion chambers 26, transition ducts 28, a turbine section 30, and an engine shaft 32 by which the turbine 20 drives the compressor 22. Several combustor-assemblies 24, 26, 28 may be arranged in a circular array known as a can-annular design although embodiments of the invention may be configured to function with other types of combustor arrangements. During operation, the compressor 22 intakes air 33 and provides a flow of compressed air 37 to the combustor inlets 23 via a diffuser 34 and a combustor plenum 36. The diffuser 34 and the plenum 36 may extend annularly about the engine shaft 32. The compressed air 37 also serves as coolant for the combustion chambers 26 and transition pieces or ducts 28. The fuel injectors housed within cap assemblies 24 mix fuel with the compressed air. This mixture burns in the combustion chamber 26 producing hot combustion gas 38, also called the working gas, that passes through the transition duct 28 to the turbine 30 via a sealed connection between an exit frame 40 of the transition duct and a turbine inlet 29. The compressed airflow 37 in the combustor plenum 36 has higher pressure than the working gas 38 in the combustion chamber 26 and in the transition duct 28.

Figure 2:
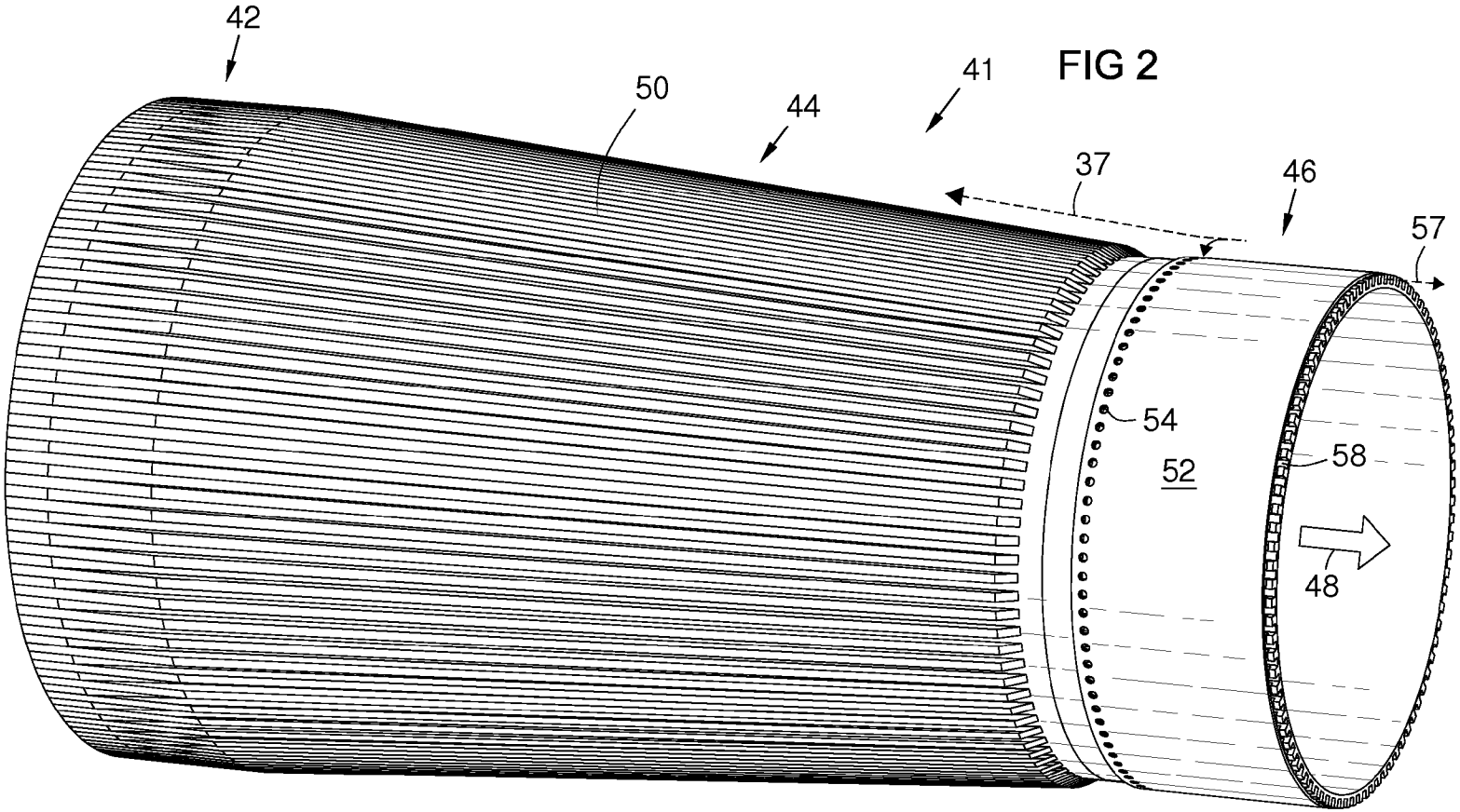
FIG. 2 is a perspective view of an exemplary combustor liner in accordance with aspects of the invention.

FIG. 2 is a perspective view of a combustor liner 41 with a front end 42, a forward section 44 and an aft section 46. Combustor liner 41 may be made from known materials such as Nimonic 263 and may have a protective coating applied to the combustion side such as an APS thermal barrier coating (TBC). Combustor liner 41 may have various cross sections along its length including front end 42 and aft section 46 each being substantially cylindrical with different diameters, and forward section 44 being substantially conical to join the front end 42 and aft section 46 together.

Herein, "forward" and "aft" mean "upstream" and "downstream", respectively, relative to the flow 48 of the combustion gas. The combustor liner 41 may form an inner wall of a double-walled enclosure that bounds the combustion chamber and the combustion gas flow path 48. The upstream or front end 42 of the liner attaches to a cap assembly 24. The outer surface of the forward section 44 may have a forward array of axially extending or axial cooling ribs or fins 50 that extend over a length of forward section 44 with each individual fins within the array of axial cooling fins 50 having tapered forward and aft ends. In an embodiment, the array of axial cooling fins 50 extends over the entire length of the forward section 44 and the individual fins within the array circumferentially spaced equidistant apart extending around all or part of the circumference of forward section 44.

The height, width, length and geometrical cross section of each axial cooling fin 50 within the array, as well as the array of axial cooling fins 62 disclosed below, may be uniform or they may vary as a function of the design criteria and/or performance requirements of combustor liner 41. For example, the inventors of the present invention have determined that the array of axial cooling fins 50, 62 may be dimensioned as a function of: a) the life of the combustor liner 41 (creep is a primary concern), b) combustor liner 41 temperatures (TBC can spall off or oxidize at high temperatures), c) dynamic concerns (weight of combustor liner 41 will impact vibration and interfacing loads with other components), and d) manufacturability. Further, the height of each fin within the array of axial fins 50, 62 may be determined by the amount of cooling needed for respective portions of combustor liner 41. However, the greater the height is for each fin within the array of axial fins 50, 62 the heavier the combustor liner 41 becomes.

Embodiments of the present invention may include individual fins within the array of axial cooling fins 50 on forward section 44 that have a height within the range of about 0.150 inches and 0.010 inches with one exemplary embodiment having a height of approximately 0.050 inches. Also, the width of each fin within the array of axial cooling fins 50 may vary axially as a function of constant spacing between them and the conical shape of forward section 44. An exemplary width of individual fins within the array of axial cooling fins 50 may be in the range of about 0.186 inches and 0.109 inches. The spacing or grooves 51, between individual fins within the array of axial cooling fins 50 may be within the range of about 0.100 inches and 0.375 inches. This range for grooves 51 is desirable in order to avoid hot spots between individual fins within the array of axial cooling fins 50 on the outer surface of forward section 44. In an exemplary embodiment, grooves 51 have a substantially constant width of approximately 0.153 inches along the length of forward section 44. This embodiment produces 170 individual fins within the array of axial cooling fins 50 that are evenly spaced around the entire circumference of forward section 44 with the width of the individual fins and grooves 51 being set at approximately a 1:1 ratio at or proximate the midsection of forward section 44.

Referring again to FIG. 2, the aft portion 46 of combustor liner 41 includes an aft array of axial extending or axial cooling fins 62 (not visible in this view) that may extend over a length of aft section 46 and be covered by a support ring 52. In an embodiment, the array of axial cooling fins 62 extends over the entire length of the aft portion 46 and the individual fins within the array are circumferentially spaced equidistant apart extending around all or part of the circumference of aft portion 46. The height, width, length and geometrical cross section of each axial cooling fin 62 within the array may be developed as described above with respect to the fins within the array of axial fins 50 on the outer surface of forward section 44. The aft portion 46 of the combustor liner 41 connects to the transition duct 28.

Figure 3:
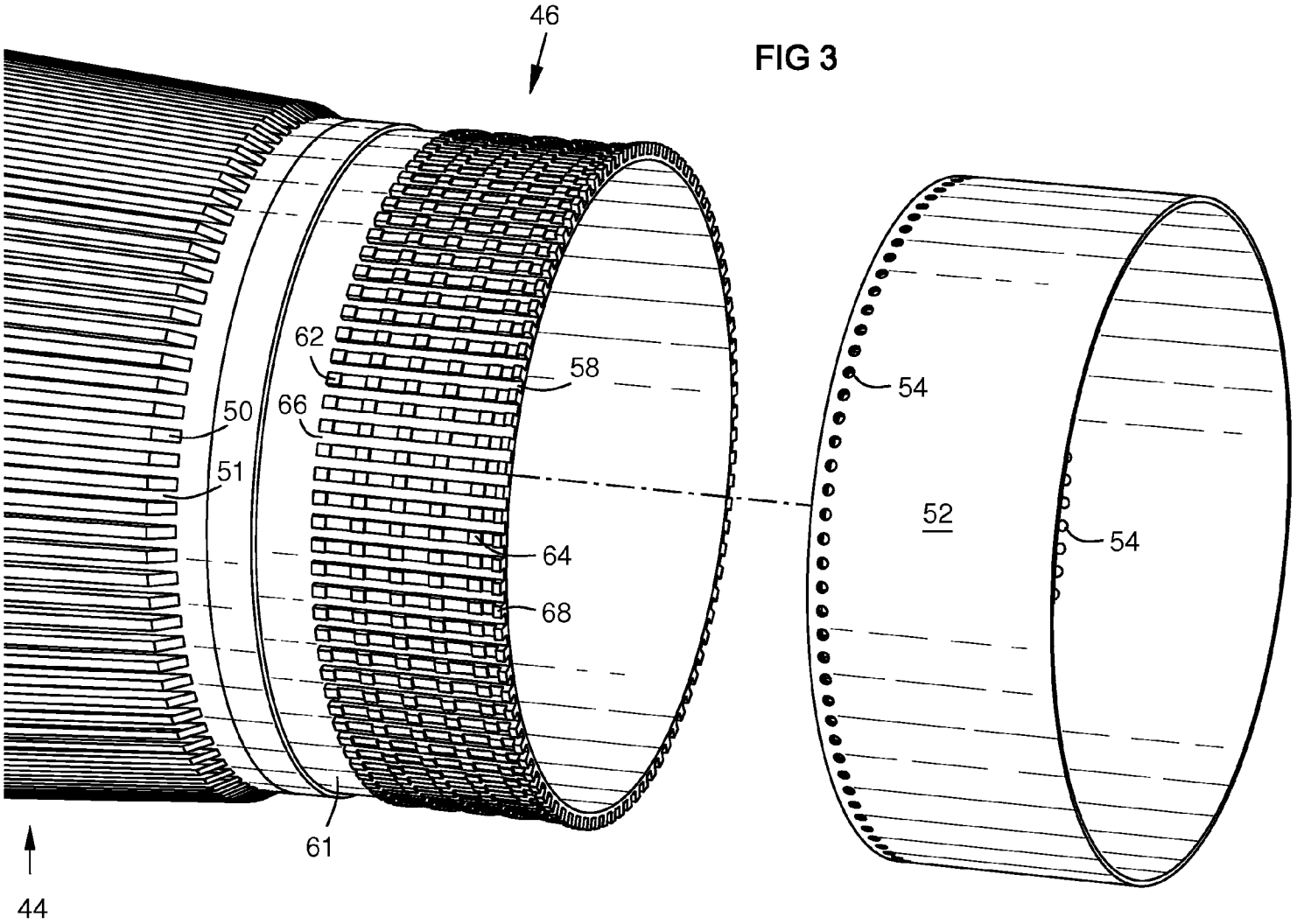
FIG. 3 is an enlarged perspective view of an aft portion of the exemplary combustor liner of FIG. 2.
Figure 5:
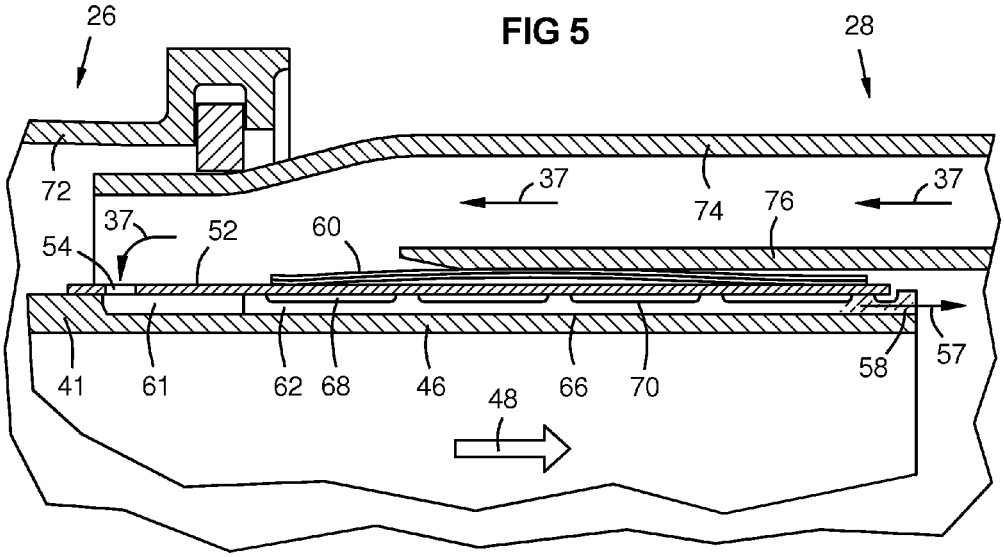
FIG. 5 is a partial sectional view of the aft portion of FIG. 3 connected to the front portion of a transition duct.

The coolant 37 may flow forward along the outer surface of the combustor liner 41 as shown in FIG. 2. The forward end of the support ring 52 may include inlet holes 54 or similar structures that admit cooling air 37 onto the spaces or grooves 66 formed between individual fins within the array of aft axial cooling fins 62 as best illustrated in FIG. 3. This portion of the coolant then emerges at 57 from the downstream end 58 of the aft axial fins 62 into the transition duct 28 as best shown in FIG. 5. Most or some of the coolant 37 may continue upstream past the support ring inlet holes 54 to convectively cool the forward array of axial cooling fins 50. Additional coolant may be added to this flow from impingement holes in the outer wall of the combustion chamber.

FIG. 3 is an enlarged perspective view of the aft portion 46 of the combustor liner 41 with the support ring 52 removed. The aft array of aft axial fins 62 is visible, each of which may include bumpers 64 that may contact the support ring 52 when placed over the aft portion 46. An impingement plenum 61 may be provided adjacent to and forward of the array of aft axial cooling fins 62. The air 37 enters the holes 54 and impinges on the aft liner 46 in this plenum 61 before flowing in the aft direction to convectively cool the array of aft axial cooling fins 62. This plenum 61 increases the effectiveness of impingement and increases uniformity of the coolant 37 across the spaces or grooves 66 formed between individual fins within the array of aft axial cooling fins 62.

Embodiments of the present invention may include individual fins within the array of axial cooling fins 62 on aft section 46 that have a height within the range of about 0.150 inches and 0.010 inches with one exemplary embodiment having a height of approximately 0.034 inches. An exemplary width of individual fins within the array of axial cooling fins 62 may be approximately 0.117 inches constant along the length of aft section 46. The spacing or grooves 66, between individual fins within the array of axial cooling fins 62 may be within the range of about 0.100 inches and 0.375 inches with an exemplary embodiment being 0.118 inches. This range for grooves 66 is desirable in order to avoid hot spots between individual fins within the array of axial cooling fins 62 on the outer surface of aft section 46. This embodiment produces 186 individual fins within the array of axial cooling fins 62 that are evenly spaced around the entire circumference of aft section 45. This embodiment may also include each bumper 64 having a height of approximately 0.044 inches.

The forward array of axial cooling fins 50 and/or the aft array of cooling fins 62 may extend axially straight with smooth surfaces on all dimensions to avoid or minimize the creation of turbulation over the outer surface area of combustor liner 41. This feature is advantageous because it reduces the pressure drop of the coolant 37 as it passes over the fins 50, 62 that would otherwise be realized with the use of conventional turbulators. The spaces or grooves 51, 66 formed between fins within the forward and/or array of aft axial cooling fins 50, 62 may extend axially straight and have smooth outer surfaces devoid of turbulators for the same reason. Aft retainer lips 68 may be provided to retain the support ring 52 when placed over the aft portion 46.

An advantage of using one or both arrays of axial cooling fins 50, 62 over the un-augmented heat transfer of air flowing over a flat plate is individual fins provide increased surface area over which cooling air 37 can flow without requiring additional hardware for impingement cooling or arrays of film holes that expend combustible air. One advantage of using non-turbulated axially extending arrays of cooling fins 50, 62 and the surface areas or grooves 51, 66 formed there between is that they create less pressure loss in the coolant 37 flow than with turbulation thus maintaining higher coolant pressure over the surface of combustor liner 41.

Figure 4:
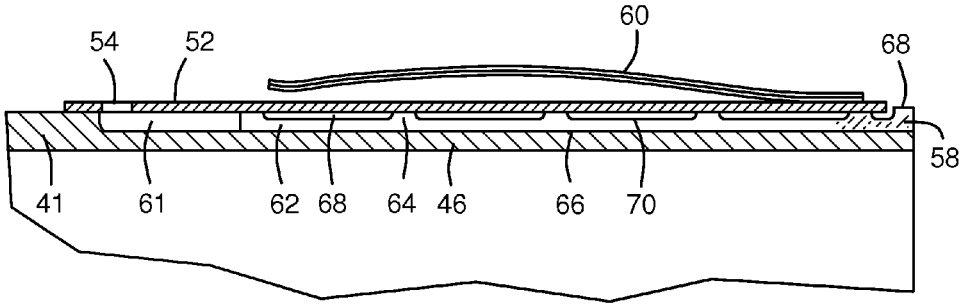
FIG. 4 is a partial sectional view of the aft portion of FIG. 3.

FIG. 4 is a partial sectional view of the aft portion 46 of the combustor liner 41 taken on an axially extending plane intersecting with the turbine axis. An annular spring seal 60 as known in the art may be attached to and encircle the support ring 52 for connection with the inner wall 76 of the transition duct 28 shown in FIG. 5. An aft axial fin 62 is shown with bumpers 64 contacting the support ring 52. The axial fins 62 may be formed by machining axial grooves 66 into the aft portion 46 of the combustor liner 41. Gaps 68 formed axially between the bumpers 64 allow circumferential cross-flow of coolant 37 between the fins 62. These gaps 68 may be formed by machining circumferential grooves 70 into the aft portion 46 of the combustor liner 41. The circumferential grooves 70 may be shallower than the axial grooves 66 or they may be formed substantially flush there with. An aft retainer lip 68 may be provided on each aft axial fin 62 to retain the support ring 52 depending on the method of assembly of the support ring onto the aft portion 46 of the liner 41.

FIG. 5 is a partial sectional view of the aft portion of a combustion chamber 26 taken on the same plane as FIG. 4. The aft portion of combustion chamber 26 may be connected to the forward portion of a transition duct 28. Combustor chamber 26 includes outer wall 72 and inner wall or combustor liner 41, and transition duct 28 includes outer wall 74 and inner wall 76. The inner wall 76 of the transition duct 28 may slide over and compress the annular spring seal 60 as known in the art.

Cooling air 37 may enter through the outer walls 72, 74 via inlets and/or impingement holes therein (not shown) as known in the art. The coolant 37 may flow in the forward direction, opposite to the working gas flow 48. A portion of the coolant 37 enters the holes 54 in the support ring 52 and then flows aft among the aft axial fins 62. At least a portion of coolant 37 discharges 57 at the exits 58 of the grooves 66 where it provides film cooling to the inner surface of the inner wall 76 of the transition duct 28. This configuration maximizes usage of the coolant 37, and thus minimizes the volume of coolant 37 needed to protect the aft portion 46 of the combustor liner 41 and the annular spring seal 60 from overheating.

Figure 6:
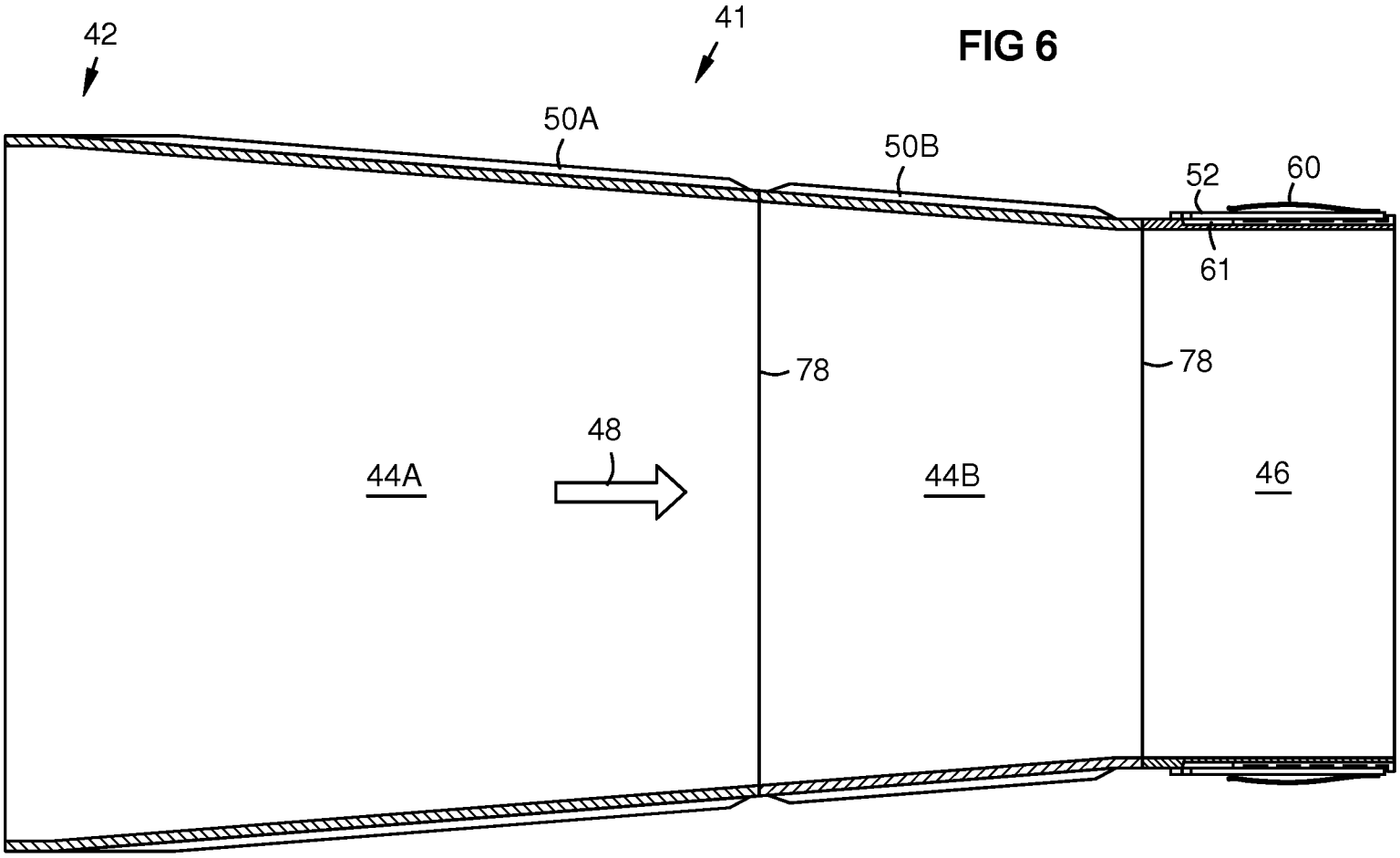
FIG. 6 is a sectional view of an exemplary combustor liner formed in segments.

FIG. 6 is a sectional view of an embodiment of the combustor liner 41 taken on the same plane as FIG. 4 with the combustor liner 41 assembled from a forward conical segment 44A, a middle conical segment 44B, and an aft cylindrical segment 46. These three segments may be interconnected in the illustrated sequence by welds 78 or other means. The forward array of axial cooling fins 50 are formed in two arrays 50A, 50B on the respective two conical segments 44A, 44B. A benefit of such segmented cone construction is that smaller subassemblies are more practical and less expansive to fabricate, store, transport and handle than a single unitary cone 44 or combustor liner 41. In addition, the alloys or other parameters of each segment 44A, 44B, 46 may be specialized for their respective location on the combustion flow.

Figure 7:
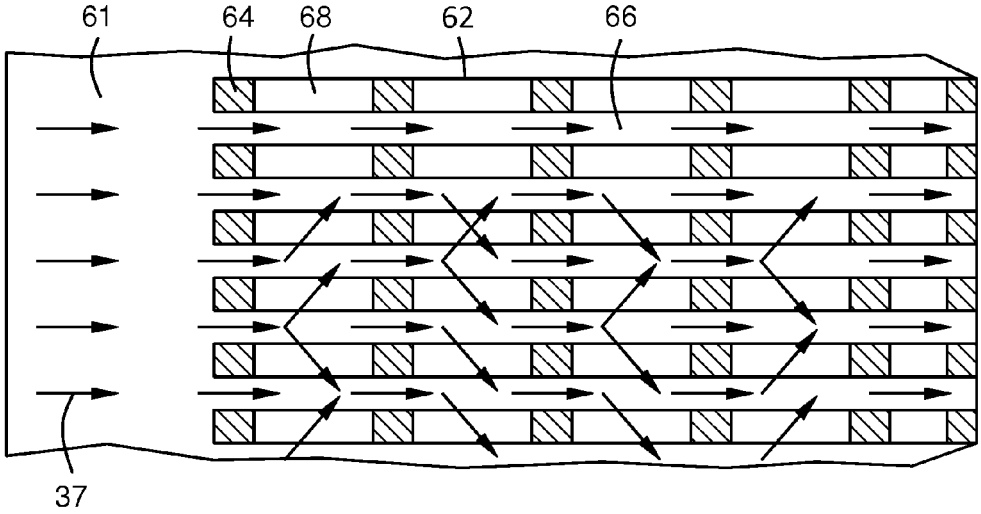
FIG. 7 is a sectional view taken on a circumferential section plane through exemplary bumpers formed on exemplary adjacent aft axial ribs.

FIG. 7 is a sectional view of the aft portion 46 of the combustor liner 41 shown in FIG. 3 taken on a circumferential section plane through the bumpers 64 of the exemplary adjacent aft axial ribs 62. As may be appreciated in this view, the coolant 37 may flow axially along grooves 66 and/or take random cross-flow paths between adjacent grooves 66 for improved cooling of the aft portion 46.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine combustion chamber liner comprising:

a forward wall section having a first outer surface;

an aft wall section connected with the forward wall section, the aft wall section having a second outer surface;

a first array of axial cooling fins formed on the first outer surface;

a second array of axial cooling fins formed on the second outer surface; and a cylindrical support ring covering the second array of axial cooling fins, the cylindrical support ring comprising a plurality of inlet holes formed along an external surface of the cylindrical support ring for admitting a coolant onto grooves formed between axial cooling fins within the second array of axial cooling fins.

2. The turbine combustion chamber liner of claim 1 further comprising:

the first array of axial cooling fins being formed straight along a longitudinal axis of the turbine combustion chamber liner and being spaced around the circumference of the first outer surface with the first array of axial cooling fins devoid of turbulators.

3. The turbine combustion chamber liner of claim 2 further comprising fins within the first array of axial cooling fins being separated by respective grooves devoid of turbulators.

4. The turbine combustion chamber liner of claim 3 further comprising the second array of axial cooling fins formed straight along the longitudinal axis of the turbine combustion chamber liner and being spaced around the circumference of the second outer surface with the second array of axial cooling fins devoid of turbulators; and the plurality of inlet holes formed around a forward end of the cylindrical support ring for admitting the coolant onto grooves formed between axial cooling fins within the second array of axial cooling fins.

5. The turbine combustion chamber liner of claim 4 further comprising an impingement plenum formed between the cylindrical support ring and the second outer surface forward of the second array of axial cooling fins, wherein the plurality of inlet holes admit the coolant into the impingement plenum, which then flows onto the grooves formed between fins within the second array of axial cooling fins.

6. A turbine combustion chamber liner comprising:

a tubular wall having a forward section and an aft section;

a first array of axial cooling fins formed on an outer surface of the aft section;

a plurality of respective grooves formed between cooling fins within the first array of axial cooling fins;

a tubular support ring covering the first array of axial cooling fins;

a plurality of coolant inlet holes formed within a forward end of the tubular support ring for admitting a coolant onto the first array of axial cooling fins and the plurality of respective grooves; and wherein the first array of axial cooling fins and the plurality of respective grooves are formed straight along a longitudinal axis of the tubular wall having smooth surfaces devoid of turbulators.

7. The turbine combustion chamber liner of claim 6 further comprising a plurality of axially spaced bumpers formed on the first array of axial cooling fins that support the tubular support and wherein an aft end of each of the plurality of respective grooves is open for discharging the coolant.

8. The turbine combustion chamber liner of claim 7 further comprising a plurality of circumferential grooves formed between the plurality of axially spaced bumpers wherein the plurality of circumferential grooves are shallower than the plurality of respective grooves.

9. The turbine combustion chamber liner of claim 6 further comprising:

a second array of axial cooling fins formed on an outer surface of the forward section; and wherein the second array of axial cooling fins are formed straight along the longitudinal axis of the tubular wall having smooth surfaces devoid of turbulators.

10. The turbine combustion chamber liner of claim 9 further comprising an impingement plenum formed between the tubular support ring and a forward end of the aft section wherein the plurality of coolant inlet holes admit the coolant into the impingement plenum, which then flows over the plurality of respective grooves.

11. The turbine combustion chamber liner of claim 10 further comprising a transition duct having a forward end that encircles and seals against the tubular support ring wherein an aft end of the plurality of respective grooves opens proximate an inner surface of the transition duct so that the coolant provides film cooling against the inner surface of the transition duct when discharged from the plurality of respective grooves.

12. The turbine combustion chamber liner of claim 6 further comprising the forward section formed as a forward conical tubular segment and a middle conical tubular segment and the aft section formed as an aft cylindrical tubular segment.

13. The turbine combustion chamber liner of claim 6 further comprising:

the first array of axial cooling fins extending around a circumference of the aft section;

a second array of axial cooling fins formed on an outer surface of the forward section and extending around a circumference of the forward section, the second array of axial cooling fins formed straight along the longitudinal axis of the tubular wall having smooth surfaces devoid of turbulators; and an impingement plenum formed between the tubular support ring and a forward end of the aft section wherein the coolant may flow through the plurality of coolant inlet holes into the impingement plenum and over the plurality of respective grooves so that the coolant exits a downstream end of the aft section.

14. A turbine combustion chamber section comprising:

an outer surface defining a circumference of the section;

a plurality of axial cooling fins formed on the outer surface, the plurality of axial cooling fins extending substantially parallel to a longitudinal axis of the section and having smooth surfaces devoid of turbulators; and a plurality of longitudinal grooves formed between ones of the plurality of axial cooling fins, the plurality of longitudinal grooves having smooth surfaces devoid of turbulators whereby a coolant flowing over the outer surface convectively cools the section;

a plurality of bumpers formed on ones of the plurality of axial cooling fins; and circumferential grooves formed between ones of the plurality of bumpers whereby the coolant may flow both axially along the plurality of longitudinal grooves and circumferentially among the plurality of longitudinal grooves by passing through the circumferential grooves.

15. The turbine combustion chamber section of claim 14 further comprising:

a support ring affixed over the plurality of axial cooling fins and the plurality of longitudinal grooves, at least a portion of the plurality of bumpers having a height sufficient to support the support ring.

16. The turbine combustion chamber section of claim 15 further comprising the circumferential grooves formed shallower than the plurality of longitudinal grooves.

17. The turbine combustion chamber section of claim 15 further comprising a transition duct having a forward end that encircles and seals against the support ring wherein an aft end of each of the plurality of longitudinal grooves opens proximate an inner surface of the transition duct to film cooling the inner surface.

18. The turbine combustion chamber section of claim 17 further comprising:

an impingement plenum formed between a forward end of the support ring and a forward end of the outer surface; and a plurality of coolant inlet holes formed above the impingement plenum whereby the coolant may flow through the plurality of inlet holes into the impingement plenum providing cooling air to the forward end of the outer surface.

19. The turbine combustion chamber section of claim 14 further comprising:

a support ring affixed over the plurality of axial cooling fins and the plurality of longitudinal grooves, at least a portion of the plurality of bumpers having a height sufficient to support the support ring;

an impingement plenum formed between a forward end of the support ring and a forward end of the outer surface; and a plurality of coolant inlet holes formed above the impingement plenum whereby the coolant may flow through the plurality of inlet holes into the impingement plenum providing cooling air to the forward end of the outer surface.

20. The turbine combustion chamber section of claim 19 further comprising a transition duct having a forward end that encircles and seals against the support ring wherein an aft end of each of the plurality of longitudinal grooves opens proximate an inner surface of the transition duct to film cool the inner surface.

* * * * *